US006805612B1

(12) United States Patent
Luk

(10) Patent No.: US 6,805,612 B1
(45) Date of Patent: Oct. 19, 2004

(54) MULTI PANEL MOLDED BRASSIERE CUP

(75) Inventor: Theone Luk, Kwai Chung (HK)

(73) Assignee: Regina Miracle International Limited (HK)

( * ) Notice: Subject to any disclaimer, the term of this patent is extended or adjusted under 35 U.S.C. 154(b) by 0 days.

(21) Appl. No.: 10/446,561

(22) Filed: May 28, 2003

(51) Int. Cl.[7] ..... A41C 3/00
(52) U.S. Cl. ..... 450/57; 2/267
(58) Field of Search ..... 450/1, 39, 54–57, 450/90, 92, 93; 2/267, 268, 243.1, 69.73, 78.1–78.4; 264/257, 258, 291, 292, 294, 320, 321, 145, 152–155, 157–160, 163; 156/245

(56) References Cited

U.S. PATENT DOCUMENTS 2,555,177 A * 5/1951 Wilson et al. ..... 450/90
3,392,731 A * 7/1968 Silverman ..... 450/57
3,399,678 A * 9/1968 Faron ..... 450/55
3,939,023 A * 2/1976 Magidson et al. ..... 156/211
4,398,981 A * 8/1983 Ellis ..... 156/91

* cited by examiner

*Primary Examiner*—Gloria M. Hale
(74) *Attorney, Agent, or Firm*—Ostrolenk, Faber, Gerb & Soffen, LLP

(57) ABSTRACT

To manufacture a brassiere cap, a first panel of moldable material is placed onto a second panel of moldable material. The panels are affixed along a fixing line across the panels defining a pre-folded assembly. Then the panel surfaces are adhered to each other at the sides of the fixing line to define a folded assembly. That assembly is molded to define a cap.

27 Claims, 4 Drawing Sheets

FIG. 1
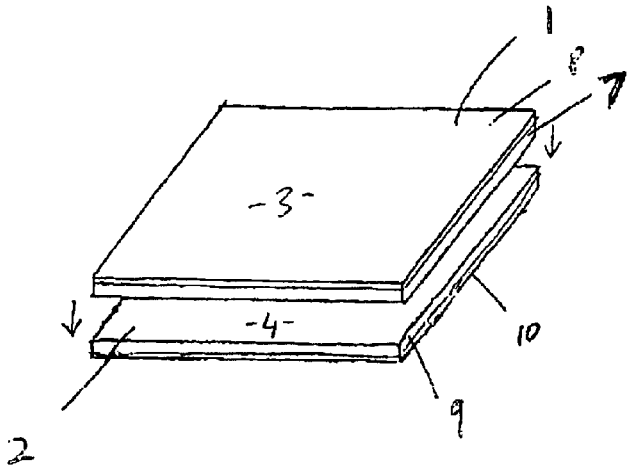
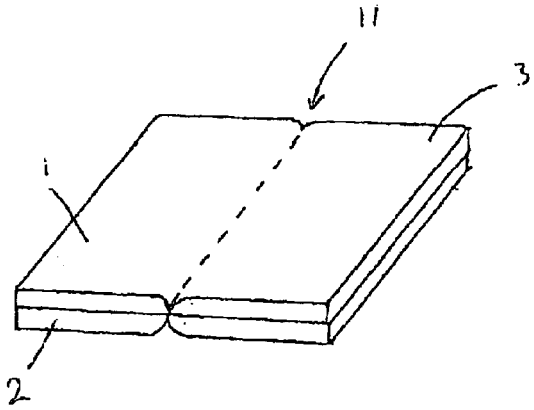
FIG. 2
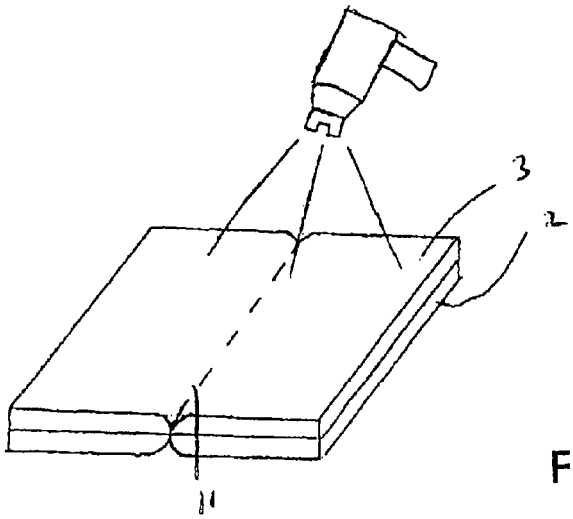
FIG. 3

FIG. 8
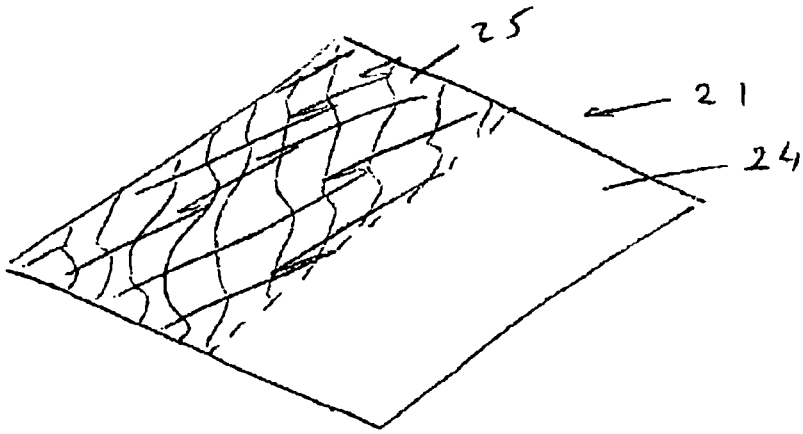
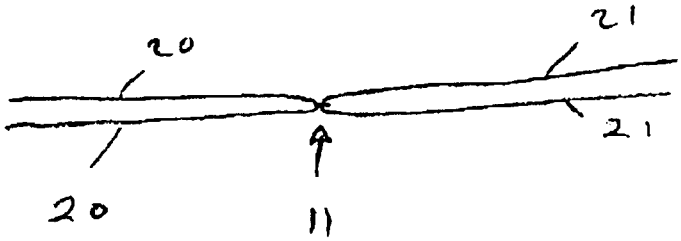
FIG. 9

MULTI PANEL MOLDED BRASSIERE CUP

FIELD OF THE INVENTION

The present invention relates to molded breast cup construction.

BACKGROUND TO THE INVENTION

Construction details of brassieres (hereinafter referred to as "bras") have been developed over many years. Construction details have evolved along with the introduction of new materials and new processes which can be utilised for the manufacturing of bras. As with most consumer products, manufacturers endeavour to reduce the cost of goods sold. A reduction in cost of goods sold can be brought about by the use of cheaper materials. For bra technology however, a significant saving in the cost of a bra can be achieved by eliminating the man-hours required to manufacture the bra. Many bras that are available on the market will include multiple panels of materials which need to be cut, and joined. Cutting can be automated, however when it comes to stitching the panels together, this will mostly be done by a person. The breast cup of a bra may consist of multiple panels which each need to be stitched together, the entire breast cup then needs to be stitched to the chest band and to the over the shoulder straps. Such is normally done by a person. It can hence be seen that in order to manufacture a bra, the labour component of the overall cost can be relatively high.

As appearances are important it is desirable to be able to provide a breast cup construction which can for example have different materials or different colours visible from the exterior (convex side) of the cup.

Accordingly it is an object of the present invention to address the abovementioned desiderata or to at least provide the public with a useful choice.

BRIEF DESCRIPTION OF THE INVENTION

Accordingly in a first aspect the present invention consists in a method of manufacturing a brassiere cup comprising, a. placing a first panel of a flexible moldable material having a first and second major surface onto a second panel of a moldable material having a first and second major surface such that the first major surface of said first panel faces the first major surface of said second panel, b. affixing said first panel with said second panel along a line (hereinafter "fixing line") extending across said panels to define a pre folded assembly of said two panels, c. adhering the second major surface of said first panel on a first side of said fixing line to the second major surface of said first panel on a second side of said fixing line, and adhering the second major surface of said second panel on a first side of said fixing line to the second major surface of said second panel on a second side of said fixing line, to define a folded assembly of said two panels each panel affixed to each other by and extending away from said fixing line, d. molding said folded assembly to define a cup shape to said folded assembly.

Preferably said affixing is by sewing.

Preferably said sewing is a single line stitching.

Preferably said fixing line is straight.

Preferably said panels are placed onto each other in a coextensive manner in said prefolded condition.

Preferably said fixing line extends from one edge of said panels to an edge substantially opposite to said one edge.

Preferably said after molding said cups shape is trimmed of excess peripheral material.

Preferably said molding and adhering are separate steps

Alternatively said molding and adhering are simultaneous steps.

Preferably said first panel prior to folding is a multi ply panel.

Preferably said first panel prior to folding includes a first ply of a foam material and a second ply affixed thereto, of a fabric material, wherein said second ply defines said first major surface of said first panel and said first ply defines said second major surface of said first panel.

Preferably said second panel prior to folding is a multi ply panel.

Preferably said second panel prior to folding includes a first ply of a foam material and a second ply affixed thereto, of a fabric material, wherein said second ply defines said first major surface of said second panel and said first ply defines said second major surface of said second panel.

Preferably said second panel prior to molding is a single ply panel.

Preferably said second panel is at least in part of a lace material.

Preferably said second panel is of a lace material on that portion thereof provided on a side of said fixing line which provides said lace on the convex side of said cup once molded.

Preferably said folded assembly is positioned for molding such that subsequent to molding said lace portion of said second panel is provided on the convex side of said cup.

A breast cup construction for incorporation into a brassiere said breast cup construction having been defined according to the method as herein above described.

A brassiere incorporating a breast cup made in accordance to the method as herein above described.

In a further aspect the present invention consists in a molded breast cup comprising:

a first and second panel each of a moldable material, engaged to each other along a line of stitching, each panel folded along said line of stitching and affixed to itself to thereby define a breast cup construction of two panels, each panel extending in opposite direction from said line of stitching.

Preferably said first panel is a multi ply panel. Preferably said first panel includes a first ply of a foam material and a second ply affixed thereto, of a fabric material, wherein said second ply defines a first major surface of said first panel and said first ply defines a second major surface of said first panel, said first major surface being exposed to define part of the convex surface and concave surface of said cup and said second major surface being adhered to itself.

Preferably said second panel is a multi ply panel. Preferably said second panel includes a first ply of a foam material and a second ply affixed thereto, of a fabric material, wherein said second ply defines a first major surface of said second panel and said first ply defines a second major surface of said second panel, said first major surface being exposed to define part of the convex surface and concave surface of said cup and said second major surface being adhered to itself.

Preferably said second panel is a single ply panel.

Preferably said second panel is at least in part of a lace material.

Preferably said second panel is of a lace material on that portion thereof provided on a side of said line of stitching which provides said lace on the convex side of said cup once molded. In a further aspect the present invention consist in a brassiere which includes two cups wherein at least one (and preferably both) is/are of a kind as hereinbefore described.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

FIG. 1 is a perspective view of two panels prior to being affixed to each other, FIG. 2 is a perspective view of the two panels having been affixed to each other preferably by a line of stitching, FIG. 3 illustrates a first panel wherein the second major surface of the first panel is being sprayed with an adhesive, FIG. 8 illustrates a panel wherein the appearance of the panel is different on each side to where the stitching is to be provided, FIG. 9 is a cross sectional view through the assembly of FIG. 7 after having been stitched together and folded about the line of stitching 11.

DETAILED DESCRIPTION OF THE INVENTION

Figure 4:
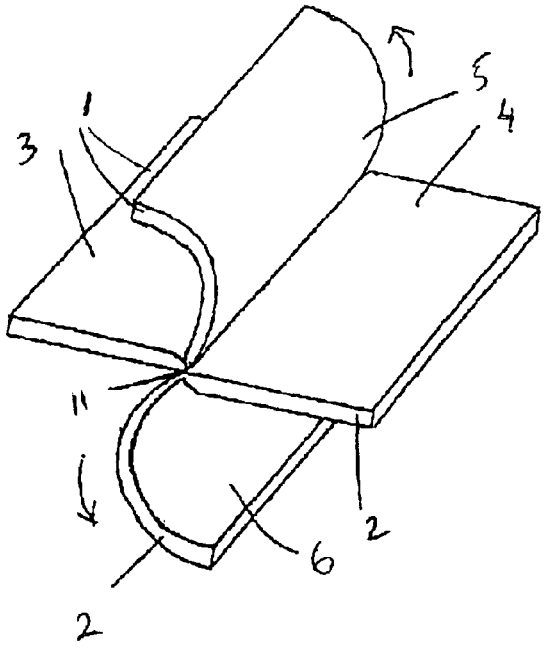
FIG. 4 illustrates the manipulation of the pre-folded assembly as per FIG. 3 being folded to a condition where the second major surfaces of the first and second panels become affixed to themselves by the folding of the first and second panels about the line of stitching.

In order to define the desired form of cup of the present invention, a first panel 1 is positioned adjacent and preferably directly against a second panel 2. The first panel includes a first major surface 5, and a second major surface 3. The second major surface 3 is that surface of panel 1 which is outwardly facing when the two panels 1, 2 are placed against each other. The second panel includes a first major surface 4 and a second major surface 6. In the most preferred form the first and second panels are substantially coextensive as for example shown in FIG. 1. Their positioning when engaged with each other are to substantially be complimentary in positioning. However it may be that a slight mismatch may exist. The first and second panels are preferably of a multi ply assembly. In the most preferred format at least one of the panels is of such a multi ply assembly however most preferably both are. The multi ply assembly configuration of the first panel 1 consists of a first ply 7 which is engaged (eg by adhesion) to a second ply 8. The first ply 7 is preferably of a fabric material such as for example a LYCRA spandex or nylon based material. The second ply 8 is preferably of a foam material such as for example a urethane foam. Accordingly the first major surface 5 of the first panel 1 is of a fabric material whereas the second major surface 3 of the panel 1 is of a foam material. Likewise the second panel 2 provides a fabric layer 9 and a foam layer 10 in its most preferred form. The fabric layer 9 defines the first major surface 4 of the second panel and the foam ply defines the first major surface 6 of the second panel.

Accordingly in a pre-folded assembled condition as for example shown in FIGS. 1 and 2 the fabric layers on the first and second panels 1 and 2 are facing each other and the foam panels are exposed outwardly both top and bottom of the assembled double panel assembly.

The first and second panels 1, 2 are of a flexible material and are engaged to each other by affixing along a line of stitching 11. The line of stitching 11 preferably extends across at least part of the unfolded assembly of the two panels. In the most preferred form the line of stitching extends across the entire panel assembly as for example shown in FIG. 2 however this need not be the case and in fact the stitching may only extend across part of the assembly and of an extent sufficient such that when the assembly is folded and molded, the stitching does extend across the molded cup form of the final form.

As can be seen in the most preferred form the first and second panels are substantially rectangular or square in shape and the stitching extends across the panel assembly between opposite sides thereof.

The line of stitching is preferably provided by a thread stitched across the panel assembly as a single straight line. This defines a line separating two portions of each panel.

With reference to FIG. 4, the line of stitching 11 allows the panels to fold thereabout. With reference to FIG. 4, the first panel 1 is folded onto itself such that the foam ply defining the second major surface of the first panel becomes engaged onto itself. Likewise the second panel 2 is folded onto itself wherein its foam ply 10 becomes engaged onto itself. This is achieved by folding the second major surfaces 6 of the second panel on each side of the line of stitching about the line of stitching to become engaged onto itself.

Figure 5:
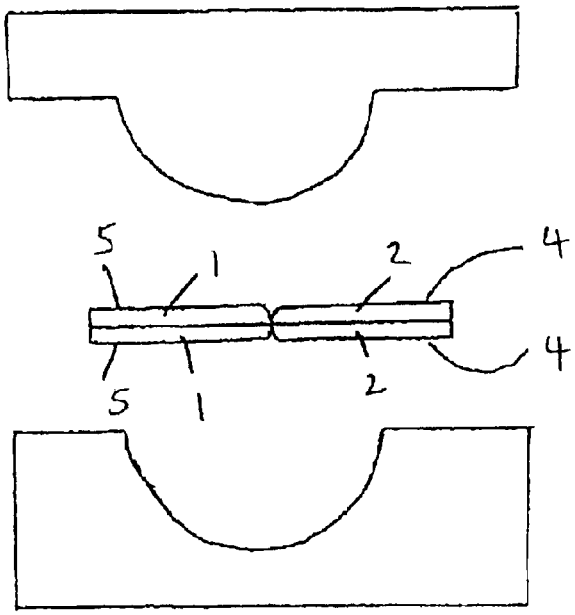
FIG. 5 illustrates the folded assembly generated according to the steps shown in FIG. 4 prior to being molded by a molding device.
Figure 6:
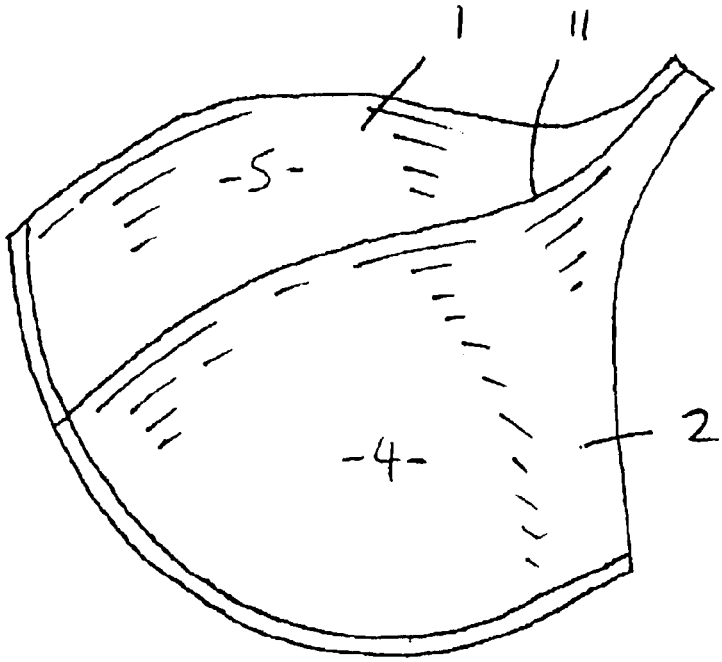
FIG. 6 illustrates a trimmed and molded folded assembly which is the result of the method according to the present invention.

In order to ensure that once folded onto itself the panels remain engaged to each other an adhesive is preferably sprayed onto the second major surfaces of the first and second panels respectively as for example shown in FIG. 3. The folded assembly as for example shown in FIG. 5 may then be placed in a molding machine and molded to define a cup form which may for example result in the cup form as shown in FIG. 6. The fabric materials 7, 9 may be chosen of a different or contrasting kind such as for example of a different colour or a different texture. This results in the final form of the cup having a visible distinction to at least the convex side as shown in FIG. 6 between the panels on each side of the line of stitching 11.

The orientation of the folded assembly relative to the molding device (see e.g. FIG. 5) is such that the line of stitching will across the cup and extend at least in part outside of the cup form of the molding machine. It preferably extends in a direction such that when molded, it extends between that portion of the cup to be engaged at or approximate to where the strap of the bra is to be provided to a lower curved portion of the cup form and approximate to the central frontal region of the brassiere. The line in general will hence extend at an angle less than 45 degrees to the horizontal and preferably closer to the horizontal than that. However the direction of the line of stitching may be entirely in a different direction dependent on the look that is desired to be created by the finished product.

Figure 7:
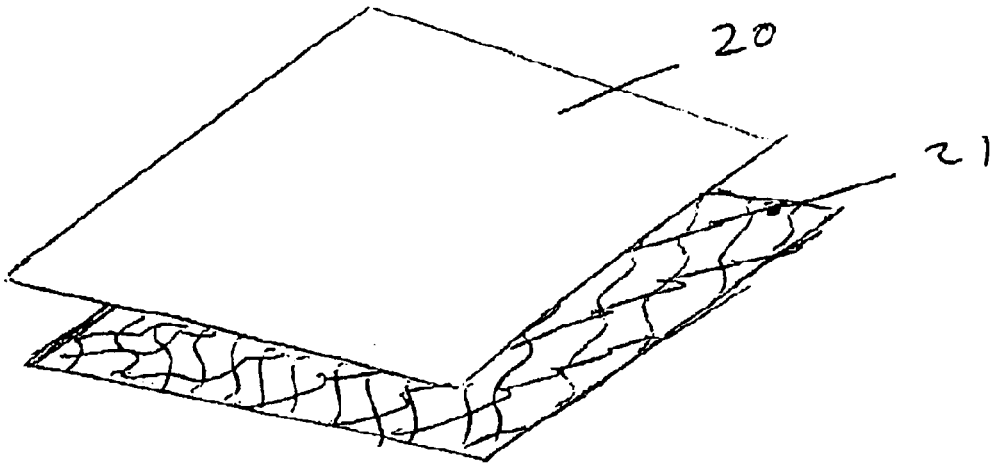
FIG. 7 illustrates a two panel unfolded assembly prior to being stitched together wherein one panel is of a different material to the other, for example the lower panel is made of lace.

FIG. 7 illustrates a two panel assembly prior to being engaged together wherein the second panel 21 is made of a material different in appearance to the first panel 20. The panel 21 may for example be of a lace material and when stitched together folded and molded to define for example the shape of FIG. 6, the lace may be provided in the upper part of the cup whereas the opaque panel 20 is provided in the lower part. Alternatively however the lace may be provided on the lower part and the opaque layer 20 on the upper part of the cup. A cross sectional view is for example shown in FIG. 9 wherein the panels 20 and 21 have been folded onto themselves and about the line of stitching 11 but prior to being molded in a cup form.

In the most preferred form it is the lace part which is provided at the upper regions of the cup upwardly from the stitching line 11 and a more supportive material is provided in the lower regions of the cup. From the configuration of FIG. 7 the lace will be folded onto lace and it may be undesirable visually to have a doubling up of a lace pattern. It is therefore possible that the second panel 21 may consist of two regions of distinct visual appearance. For example a first region 25 may be of the lace material whereas the second region 24 is perhaps of a chiffon or opaque material. The sheet may have been created by stitching together or may have been created from a single original panel. The division between the two regions 24 and 25 is preferably along a line commensurate with the to be line of stitching 11 between the panel 21 and the to be introduced panel 20. When panel of a kind as per FIG. 8 is sewn to a second panel it is most preferably the opaque region 24 which gets folded against the to be concave side of the lace region 25. In this way the lace would be exposed to the convex side of the breast cup.

For the preferred materials, molding may occur at 200° C. to 120° C. with dwell time adjusted appropriately. In one example, the upper mold portion may be heated to 200° C. and the lower mold portion may be heated to 198° C. and a mold closed condition may be maintained to introduce the desired cup shape to the panel assembly for approximately 120 seconds. Once molded the excess material of the then molded panel assembly can be trimmed (e.g. by scissors). Such trimming may alternatively be achieved by in-mold trimming with the use of for example suitable trimming elements.

What is claimed is:

1. A method of manufacturing a brassiere cup comprising:

a. placing a first panel of a flexible moldable material having a respective first and second major surface onto a second panel of a moldable material having a respective first and second major surface such that said first major surface of said first panel faces said first major surface of said second panel, b. affixing said first panel with said second panel along a fixing line extending across said panels to define an assembly of said two panels, c. adhering said second major surface of said first panel initially on a first side of said fixing line to said second major surface of said first panel on a second side of said fixing line, and adhering said second major surface of said second panel initially on said second side of said fixing line to said second major surface of said second panel on said first side of said fixing line, to define a folded assembly of said two panels, wherein each said panel is folded at said fixing line such that each said panel when folded extends away from said fixing line, thereby forming said assembly into a folded assembly, d. molding said folded assembly to define a cup shape to said folded assembly.

2. A method as claimed in claim 1 wherein said affixing is by sewing.

3. A method as claimed in claim 2 wherein said sewing is a single line stitching.

4. A method as claimed in claim 1 wherein said fixing line is straight.

5. A method as claimed in claim 1 wherein said first and second panels are placed onto each other in a coextensive manner in said assembly.

6. A method as claimed in claim 1 wherein said first and second panels have opposite edges and said fixing line extends between said opposite edges of said panels.

7. A method as claimed in claim 1 wherein after said molding, said cup shape is trimmed of excess peripheral material.

8. A method as claimed in claim 1 wherein said molding and adhering are separate steps.

9. A method as claimed in claim 1 wherein said molding and adhering are simultaneous steps.

10. A method as claimed in claim 1 wherein said first panel is a multi ply panel.

11. A method of manufacturing a brassiere cup as claimed in claim 1 wherein said first panel prior to folding includes a first ply of a foam material and a second ply affixed to said first ply, of a fabric material, wherein said second ply defines said first major surface of said first panel and said first ply defines said second major surface of said first panel.

12. A method as claimed in claim 1 wherein said second panel is a multi ply panel.

13. A method as claimed in claim 1 wherein said second panel prior to folding includes a first ply of a foam material and a second ply of a fabric material affixed to said first ply, wherein said second ply defines said first major surface of said second panel and said first ply defines said second major surface of said second panel.

14. A method as claimed in claim 1 wherein said second panel prior to molding is a single ply panel.

15. A method as claimed in claim 1 wherein said second panel is at least in part of a lace material.

16. A method as claimed in claim 1 wherein said molded cup has a shape including a convex side, said second panel is of a lace material on a portion thereof initially provided on a side of said fixing line for providing said lace on said convex side of said cup once molded.

17. A method as claimed in claim 16 wherein said folded assembly is positioned for molding such that subsequent to molding of said cup shape, said lace material portion of said second panel is provided on said convex side of said cup.

18. A breast cup construction for incorporation into a brassiere said breast cup construction having been defined according to the method as claimed in claim 1.

19. A brassiere incorporating a breast cup made in accordance to the method of claim 1.

20. A molded breast cup comprising a first and second panel, each panel being of a moldable material, said first panel is a multi ply panel, said first and second panels being overlaid and being engaged to each other along a line of stitching, each panel being folded onto itself along said line of stitching wherein each panel extends in a respective opposite direction from said line of stitching each respective said panel being affixed to itself when said panel is folded to thereby define a breast cup construction of said two panels.

21. A cup as claimed in claim 20 wherein said cup is molded to a shape having a convex surface and a concave surface; said first panel includes a first ply of a foam material and a second ply of a fabric material affixed to said first ply, wherein said second ply of said first panel defines a first major surface of said first panel and said first ply defines a second major surface of said first panel, said first major surface being exposed to define part of said convex surface and of said concave surface of said cup, and said second major surface after said folding being adhered to itself.

22. A cup as claimed in claim 20 wherein said second panel is a multi ply panel.

23. A cup as claimed in claim 20 wherein said cup is molded to a shape having a convex surface and a concave surface; said second panel includes a first ply of a foam material and a second ply, of a fabric material affixed to said first ply, wherein said second ply defines a first major surface of said second panel and said first ply defines a second major surface of said second panel, said first major surface being exposed to define part of said convex surface and of said concave surface of said cup, and said second major surface after said folding being adhered to itself.

24. A cup as claimed in claim 20 wherein said second panel is a single ply panel.

25. A cup as claimed in claim 24 wherein said second panel is at least in part of a lace material.

26. A cup as claimed in claim 20 wherein said cup is molded to a shape having a convex surface and a concave surface; said second panel is of a lace material on a portion of said second panel that is on a side of said line of stitching, said portion of said second panel provides said lace on said convex side of said cup once molded.

27. A brassiere which includes two cups wherein at least one of the cups is as claimed in claim 20.

* * * * *